US006127617A

United States Patent [19]

Suzuki

[11] Patent Number: 6,127,617

[45] Date of Patent: Oct. 3, 2000

[54] EFFECTOR DIFFERENTLY CONTROLLING HARMONICS AND NOISES TO IMPROVE SOUND FIELD EFFECT

[75] Inventor: Hideo Suzuki, Hamamatsu, Japan

[73] Assignee: Yamaha Corporation, Hamamatsu, Japan

[21] Appl. No.: 09/154,759

[22] Filed: Sep. 17, 1998

[30] Foreign Application Priority Data

Sep. 25, 1997 [JP] Japan ..... 9-259728

[51] Int. Cl.[7] ..... G10H 1/08; G10H 7/00

[52] U.S. Cl. ..... 84/625; 84/660

[58] Field of Search ..... 84/625, 626, 660, 84/662

[56] References Cited

U.S. PATENT DOCUMENTS

| | | | |
|---|---|---|---|
| 5,241,604 | 8/1993 | Noguchi | 84/630 X |
| 5,406,022 | 4/1995 | Kobayashi | 84/622 |
| 5,572,591 | 11/1996 | Numazu et al. | 84/630 X |
| 5,602,358 | 2/1997 | Yamamoto et al. | 84/662 |
| 5,732,142 | 3/1998 | Nagata et al. | 84/622 X |

FOREIGN PATENT DOCUMENTS

| | | |
|---|---|---|
| 60-52896 | 3/1985 | Japan . |
| 4-116697 | 4/1992 | Japan . |
| 4-340999 | 11/1992 | Japan . |
| 272544 | 12/1997 | Japan . |
| 2751258 | 2/1998 | Japan . |

*Primary Examiner*—Jeffrey Donels
*Attorney, Agent, or Firm*—Graham & James LLP

[57] ABSTRACT

A music apparatus is constructed for producing a music sound while applying thereto a desired sound field effect according to a control parameter. In the music apparatus, a source device provides an input music sound composed of at least two sound components separable from each other. A multiplier device multiplies levels of the two sound components by different multiplication factors for undergoing a level change of the two sound components separately from each other. An adder device adds the two sound components with each other after the level change to produce an output music sound. An effector device applies the sound field effect to the output music sound according to the control parameter which characterizes the sound field effect. A controller device adjusts the respective multiplication factors according to the control parameter so that the levels of the two sound components can be regulated provisionally in matching with the sound field effect.

10 Claims, 8 Drawing Sheets

EFFECTOR DIFFERENTLY CONTROLLING HARMONICS AND NOISES TO IMPROVE SOUND FIELD EFFECT

BACKGROUND OF THE INVENTION

1. Field of the Invention

The present invention generally relates to an apparatus for applying a desired sound field effect to a music sound that contains a non-harmonic component such as a noise in addition to a harmonic component.

2. Description of Related Art

To apply the realism of live performance to music sound signals such as an instrument sound signal and a voice sound signal, a reverberation effect is conventionally created by a sound field effect applying apparatus as disclosed in Japanese Published Unexamined Patent Application No. Sho 60-52896, for example. Such a reverberation effect is created by simulating an acoustic behavior of sounds in which a generated music sound directly reaches a listener from a musical instrument in an actual performance and an indirect music sound reflected from wall or ceiling reaches the listener with a certain delay relative to the direct music sound. Generally, the reverberation effect is created by controlling the mixing ratio between a generated music sound signal and a processed music sound signal obtained by delaying the generated music sound signal. As the level or amplitude of the delayed music sound signal is raised relative to that of the generated music sound signal, the sound field effect having a great distance perspective is created.

On the other hand, to electrically generate a music sound of an acoustic musical instrument with high fidelity, a conventional electronic musical instrument adds a noise to a harmonics component of a music sound when generating the same, as described in Japanese Published Unexamined Patent Application Nos. Hei 4-116697 and Hei 4-340999, for example. The term "noise" herein denotes a non-harmonic blowing sound generated when blowing a wind instrument such as a flute and a non-harmonic rubbing sound generated when a bow is rubbed against a string of a stringed instrument such as a violin. To impart a desired sound field effect in an electronic musical instrument that reproduces a music sound of an acoustic musical instrument more faithfully, a music sound signal intentionally added with a noise is inputted in the above-mentioned sound field applying apparatus.

Generally, a natural noise generated during the play of an acoustic musical instrument has a characteristic that the noise is actually heard well or relatively conspicuous when the sound source is near enough to a listener. As the distance between the sound source and the listener increases, it becomes more difficult for the listener to recognize the noise.

An attempt is made to apply a sound field effect having distance perspective or sense of distance by the above-mentioned sound field effect applying apparatus to a music sound added with a noise by the above-mentioned electronic musical instrument. In such a case, it is necessary to increase the level of the delayed music sound signal when enhancing the sense of distance. This inevitably causes increase in the level of the noise contained in the delayed music sound signal at the same time. Therefore, the attempt to impart the sound field effect having the distance perspective results in an unnaturally conspicuous noise, thereby failing to create the realistic sound field effect. Thus, the conventional arrangement presents a problem that performance atmospherics varying with an actual situation cannot be rendered sufficiently.

SUMMARY OF THE INVENTION

It is therefore an object of the present invention to provide a sound field applying apparatus for applying a sound field effect in response to distance perspective, thereby presenting performance atmospherics very close to those produced by a live performance.

The inventive apparatus is constructed for applying a desired sound field effect to a music sound signal composed of at least two signal components. In the inventive apparatus, level regulating means is provided for conducting a level regulation to regulate levels of the two signal components independently from each other. Sound field applying means is provided for applying the sound field effect to the music sound signal containing the two signal components subjected to the level regulation by the level regulating means. Level controlling means is provided for controlling the level regulation of the level regulating means according to the sound field effect applied by the sound field applying means.

Preferably, the inventive apparatus further comprises providing means for providing the level regulating means with a music sound signal composed of a harmonic signal component containing a fundamental wave and overtone waves of the music sound signal and a non-harmonic signal component containing other than the fundamental wave and the overtone waves. In such a case, the sound field applying means applies the sound field effect to create a sense of distance in the music sound signal, and the level controlling means controls the level regulation according to the sense of distance created by the sound field effect such that the level of the non-harmonic signal component is made small relative to the level of the harmonic signal component as the sense of distance becomes far.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

This invention will be described in further detail by way of example with reference to the accompanying drawings.

1: Constitution of preferred embodiment

The present preferred embodiment is an electronic musical instrument incorporating a sound field effect applying apparatus associated with the invention. The sound field effect applying apparatus applies a sound field effect having distance perspective not only to a music sound signal generated internally in response to play operation performed on a keyboard of the electronic musical instrument, but also to an externally supplied music sound signal.

Figure 1:
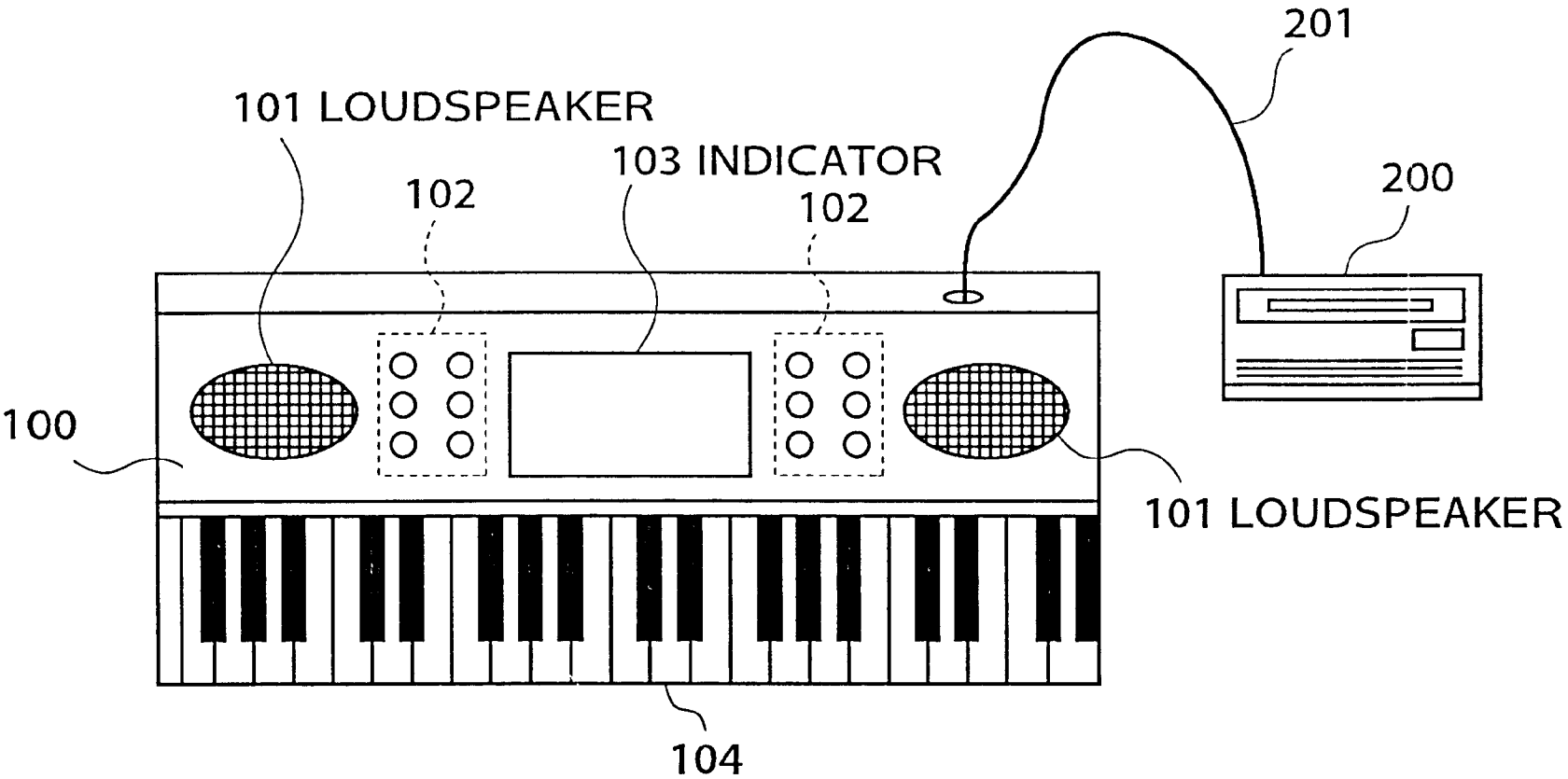
FIG. 1 is a schematic diagram illustrating a constitution of an electronic musical instrument practiced as one preferred embodiment of the invention.

FIG. 1 shows an overall constitution of this electronic musical instrument. As shown, a main frame 100 of the electronic musical instrument has loudspeakers 101 for sounding a music sound outside, an operator panel 102 for setting a sound field effect, a volume, a timbre, and other parameters, an indicator 103 for displaying a setting state, and a keyboard 104 composed of 88 keys (only a part thereof is shown).

The operator panel 102 is composed of a plurality of switches, and outputs control information set by each switch. In the present embodiment, a sound field effect is specified by setting a control parameter indicative of distance perspective through the operator panel 102. Each of the keys constituting the keyboard 104 is provided with a sensor, not shown. Pressing any of these keys outputs key-on data including note data indicative of the pitch of a note corresponding to the pressed key. On the other hand, releasing the pressed key outputs key-off data including note data indicative of the pitch of a note corresponding to the released key. The main frame 100 is connected to an audio system 200 through a cable 201. This connection enables to apply a sound field effect to a music sound signal coming from the audio system 200. The signal coming from the audio system 200 is reproduced from a music sound of an acoustic musical instrument or a voice inputted from a microphone, for example.

The electronic musical instrument associated with the invention creates a sound field effect in one of the following two modes. One is the internal sound mode, in which a sound field effect is applied to an internal music sound signal generated by pressing a key on the keyboard 104. The other is the external sound mode, in which a sound field effect is applied to an external music sound signal supplied from the audio system 200. These modes are selected by means of the operator panel 102. Alternatively, an arrangement may be made in which the connection of the cable 201 automatically selects one of these modes.

1-1: Electrical constitution

Figure 2:
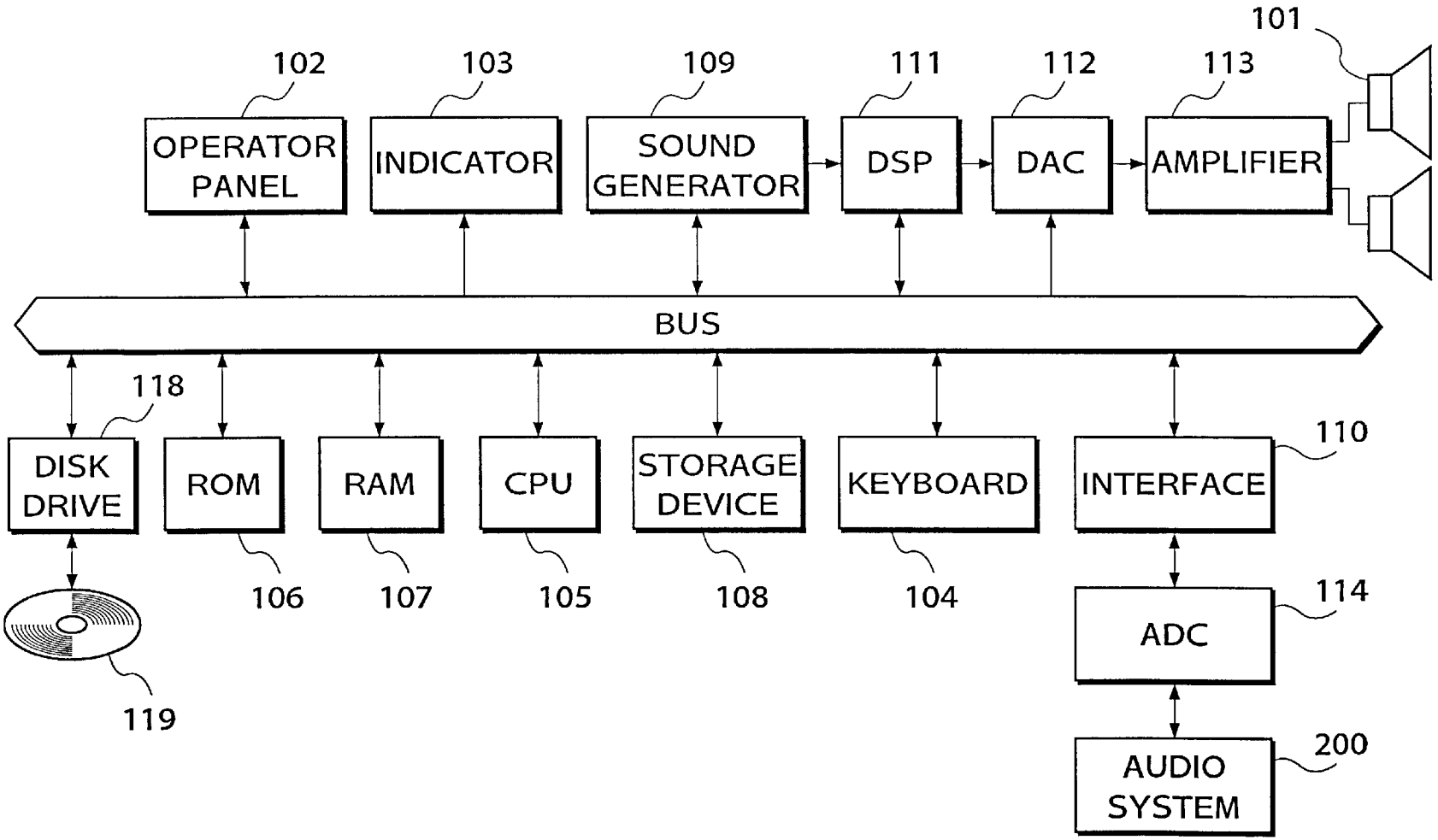
FIG. 2 is a block diagram illustrating a hadware constitution of the above-mentioned embodiment.

The following describes the hardware constitution of the embodied electronic musical instrument with reference to FIG. 2. A CPU 105 operates based on a program stored in a ROM 106 to control other parts of the musical instrument interconnected through a bus. A RAM 107 has a work area for use in controlling this electronic musical instrument, and stores data such as numeric values entered by the user from the operator panel 102. A storage device 108 stores performance data which is based on MIDI standard for use in automatic performance, and timbre data for specifying user-unique timbres. This storage device 108 is comprised of a hard disk unit, for example. An interface 110 accepts a music sound signal from the audio system 200 when this electronic musical instrument is in the external sound mode. To be more specific, an analog music sound signal provided from the audio system 200 is converted by an A/D converter (ADC) 114 into a digital music sound signal, which is accepted by this external interface 110.

On the other hand, based on the data inputted through the bus, a sound generator 109 generates an internal digital music sound signal composed of a harmonic component and a non-harmonic component of a music sound when this electronic musical instrument is in the internal sound mode. The harmonic component contains a fundamental wave and overtone waves that are in harmonics relation with the fundamental wave. For example, the harmonic component is generated by reading a stored basic waveform of a typical timbre by a pitch specified by operation of the keyboard 104. The non-harmonic component is equivalent to a noise obtained by removing the harmonic component from the music sound to be generated. For example, the non-harmonic component is generated by filtering a white noise through a filter having a frequency response corresponding to the specified timbre and pitch.

Under the control of the CPU 105, a DSP (Digital Signal Processor) 111 executes an algorithm for creating a desired sound field effect applied to a music sound signal supplied from the sound generator 109 or the external interface 110. The DSP 111 has an internal register for data computation. A D/A converter (DAC) 112 converts a digital music sound signal supplied from the DSP 111 into an analog music sound signal, which is then amplified by an amplifier 113 to be sounded by the loudspeakers 101.

1-2: Sound field effect applying circuit

Figure 3:
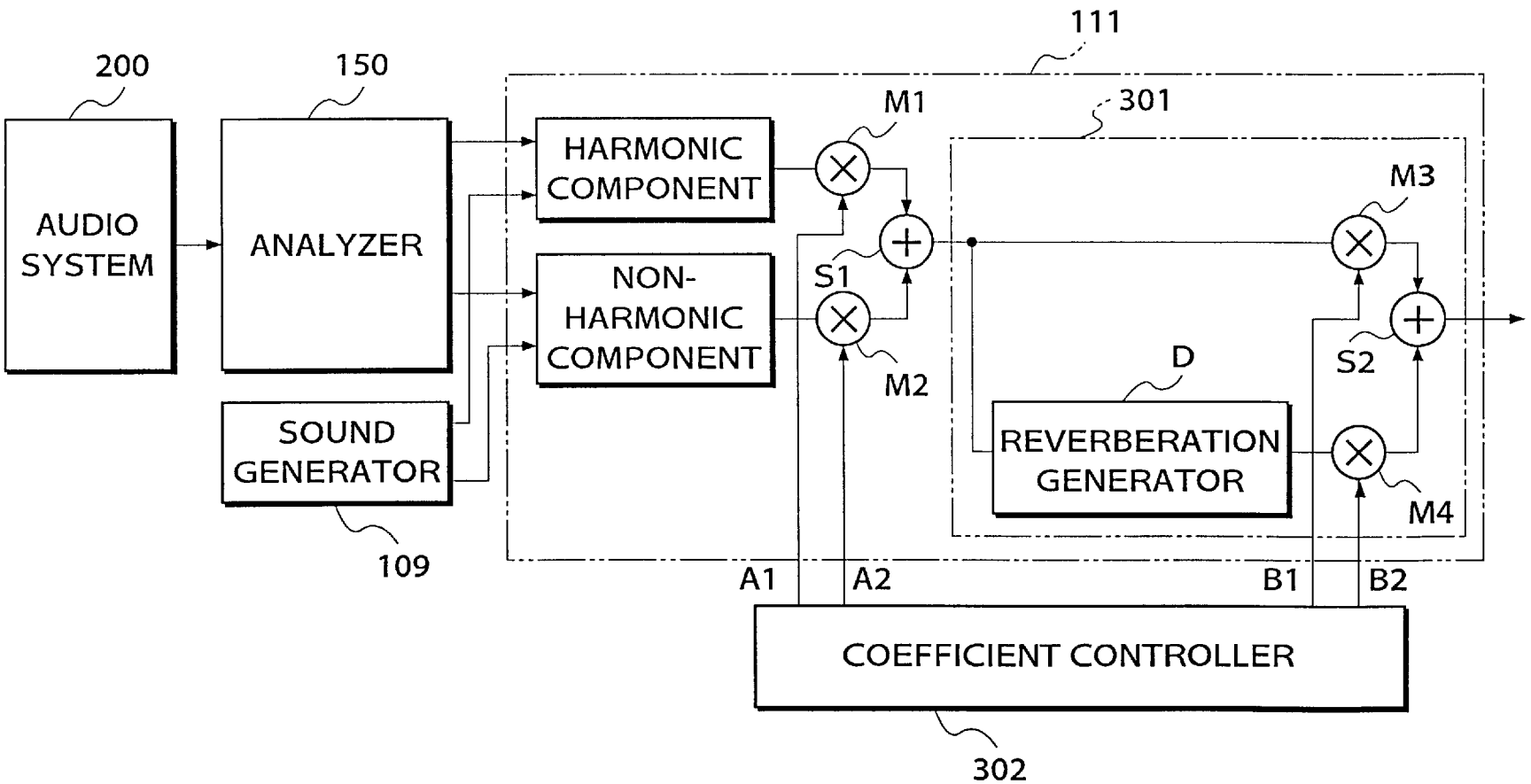
FIG. 3 is a block diagram illustrating an algorithm of creating a sound field effect in the above-mentioned embodiment.

The following describes the above-mentioned sound field effect applying algorithm to be equivalently formed by means of the DSP 111 and peripherals of this algorithm with reference to FIG. 3. In the figure, an analyzer 150 separates an external music sound signal supplied from the audio system 200 into a harmonic signal component and a non-harmonic signal component when this electronic musical instrument is in the external sound mode. This separation is processed as follows. First, known FFT (Fast Fourier Transform) is executed on the externally supplied music sound signal. From the result of this FFT processing, fundamental and overtone waves are extracted as the harmonic component, while the remaining noises other than the fundamental and overtone waves are extracted as the non-harmonic component. The analyzer 150 may be controlled by the CPU 105 shown in FIG. 2, or may be an independent device having equivalent capabilities.

On the other hand, the sound generator 109 generates the internal music sound signal originally containing the harmonic component and the non-harmonic component separately from each other when the electronic musical instrument is in the internal sound mode.

In either case where the electronic musical instrument is in the external or internal mode, the music sound signal composed of the harmonic component and the non-harmonic component is supplied to the DSP 111. The signal indicative of the harmonic component is multiplied by a multiplication factor or coefficient A1 through a multiplier M1. The signal indicative of the non-harmonic component is multiplied by another multiplication factor or coefficient A2 through a multiplier M2. The results of these multiplying operations are added with each other through an adder S1.

The sound field effect set by the operator panel 102 shown in FIGS. 1 and 2 is applied to the result of the addition by a reverberation effect applying module 301. To be more specific, the result of the addition executed by the adder S1 is multiplied by a coefficient B1 through a multiplier M3 to provide a signal equivalent to a direct music sound as shown in FIG. 3. The result of the addition executed by the adder S1 is delayed by a time equivalent to a reflection of the music sound by a reverberation generator D. The output of the reverberation generator D is multiplied by another coefficient B2 through a multiplier M4 to provide a signal equivalent to a reflected music sound. Then, the signal indicative of the direct sound and the signal indicative of the reflected sound are added with each other by an adder S2. The result of this addition is supplied to the DAC 112 shown in FIG. 2 as an output music sound signal imparted with a reverberation effect creating the sense of distance.

Figure 4A:
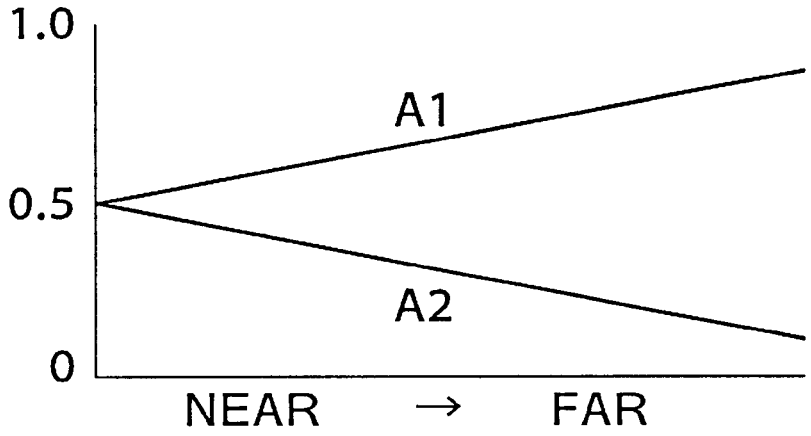
FIG. 4A is a diagram illustrating a relationship between a parameter representing distance perspective and coefficients A1 and A2.

A coefficient controller 302 outputs the coefficients A1 A2, B1, and B2 adjusted by the control parameter indicative of the distance perspective or the sense of the distance created by the sound field effect. FIG. 4A shows a relationship between the coefficients A1 and A2 and the distance perspective parameter. As shown, as the distance perspective to be given gets broader, the signal level of the harmonic component is adjusted to get higher while the signal level of the non-harmonic component is adjusted to get lower. Namely, the setting of the coefficients A1 and A2 is made according to the distance perspective parameter by the coefficient controller 302 so that the level ratio of the non-harmonic component to the harmonic component gets smaller as the distance becomes remote or father.

Figure 4B:
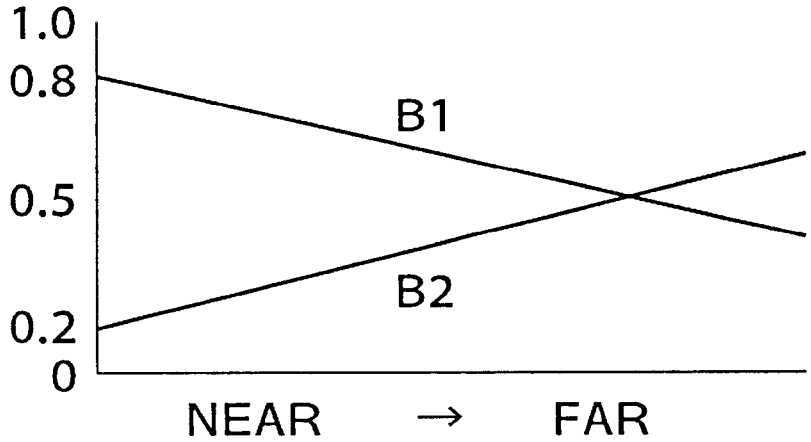
FIG. 4B is a diagram illustrating a relationship between a parameter representing distance perspective and coefficients B1 and B2.

FIG. 4B shows a relationship between the coefficients B1 and B2 and the distance perspective parameter. As described in the related-art technology, as the distance perspective to be given gets broader, the level of the signal equivalent to the direct sound gets lower while the level of the signal equivalent to the reflected sound gets higher. Namely, the setting of the coefficients B1 and B2 is made according to the distance perspective parameter by the coefficient controller 302 so that the level ratio of the non-harmonic component to the harmonic component gets greater as the distance becomes remote or father.

Consequently, when the distance perspective to be given gets broader, the level of the signal equivalent to the reflected sound gets greater, while the signal level of the non-harmonic component gets smaller in correlation therewith, thereby eventually lowering the signal level of the non-harmonic component contained in the reflected sound signal. Therefore, in the present embodiment, the acoustic nature of a music sound noise can be appropriately simulated, therby creating the sound field effect which sounds significantly natural.

The coefficient controller 302 in the present embodiment is implemented as follows. Namely, the CPU 105 generates a control parameter indicative of the distance perspective according to the effect setting by the operator panel 102, and the coefficient controller 302 supplies the coefficients A1, A2, B1, and B2 adjusted by the control parameter. Alternatively, the coefficient controller 302 may be constituted by an independent device having equivalent capabilities as that of the coefficient controller. It should be noted that the characteristics of the coefficients A1, A2, B1, and B2 are not limited to the examples shown in FIGS. 4A and 4B. Essentially, the setting may be made so that, as the distance perspective to be given gets broader, the ratio of the coefficient A2 to the coefficient A1 gets smaller.

As described above, the inventive effect applying apparatus is constructed for applying a desired sound field effect to a music sound signal composed of at least two signal components. In the effect applying apparatus, level regulating means is provided in the form of the multipliers M1 and M2 for conducting a level regulation to regulate levels of the two signal components independently from each other. Sound field applying means is provided in the form of the reverberation effect applying module 301 for applying the sound field effect to the music sound signal containing the two signal components subjected to the level regulation by the level regulating means. Level controlling means is provided in the form of the coefficient controller 302 for controlling the level regulation of the level regulating means according to the sound field effect applied by the sound field applying means.

Preferably, the inventive effect applying apparatus further comprises providing means in the form of the sound generator 109 for providing the level regulating means with a music sound signal composed of a harmonic signal component containing a fundamental wave and overtone waves of the music sound signal and a non-harmonic signal component containing other than the fundamental wave and the overtone waves. In such a case, the sound field applying means applies the sound field effect to create a sense of distance in the music sound signal, and the level controlling means controls the level regulation according to the sense of distance created by the sound field effect such that the level of the non-harmonic signal component is made small relative to the level of the harmonic signal component as the sense of distance becomes far.

Further, according to the invention, the music apparatus is constructed in the form of the electronic musical instrument for producing a music sound while applying thereto a desired sound field effect according to a control parameter. In the music apparatus, a source device composed of the sound generator 109 or else provides an input music sound composed of at least two sound components separable from each other. A multiplier device composed of the multipliers M1 and M2 multiplies levels of the two sound components by different multiplication factors A1 and A2 for undergoing a level change of the two sound components separately from each other. An adder device composed of the adder S1 adds the two sound components after the level change to produce an output music sound. An effector device composed of the effect module 301 applies the sound field effect to the output music sound according to the control parameter which characterizes the sound field effect. A controller device composed of the coefficient controller 302 adjusts the respective multiplication factors A1 and A2 according to the control parameter so that the levels of the two sound components can be regulated provisionally in matching with the sound field effect.

Specifically, the source device provides an input music sound composed of a harmonic sound component containing a fundamental wave and overtone waves of the music sound and a non-harmonic sound component containing a noise other than the fundamental wave and the overtone waves, so that the respective levels of the harmonic sound component and the non-harmonic sound component can be regulated to enhance the sound field effect created by the effector device. The effector device applies the sound field effect to create a sense of distance in the music sound. The controller device controls the respective levels of the harmonic sound component and the non-harmonic sound component to enhance the sense of distance created by the effector device such that the level of the non-harmonic sound component is made small relative to the level of the harmonic sound component as the sense of distance becomes remote.

The source device comprises the sound generator 109 that generates an input music sound composed of the harmonic sound component and the non-harmonic sound component, which are generated separately from each other. Further, the source device comprises a sound player or the audio system 200 that reproduces an input music sound composed of the harmonic sound component and the non-harmonic sound component, and the analyzer device 150 that analyzes the reproduced input music sound to separate the harmonic sound component and the non-harmonic sound component from each other.

2: Operation of embodiment

Figure 5:
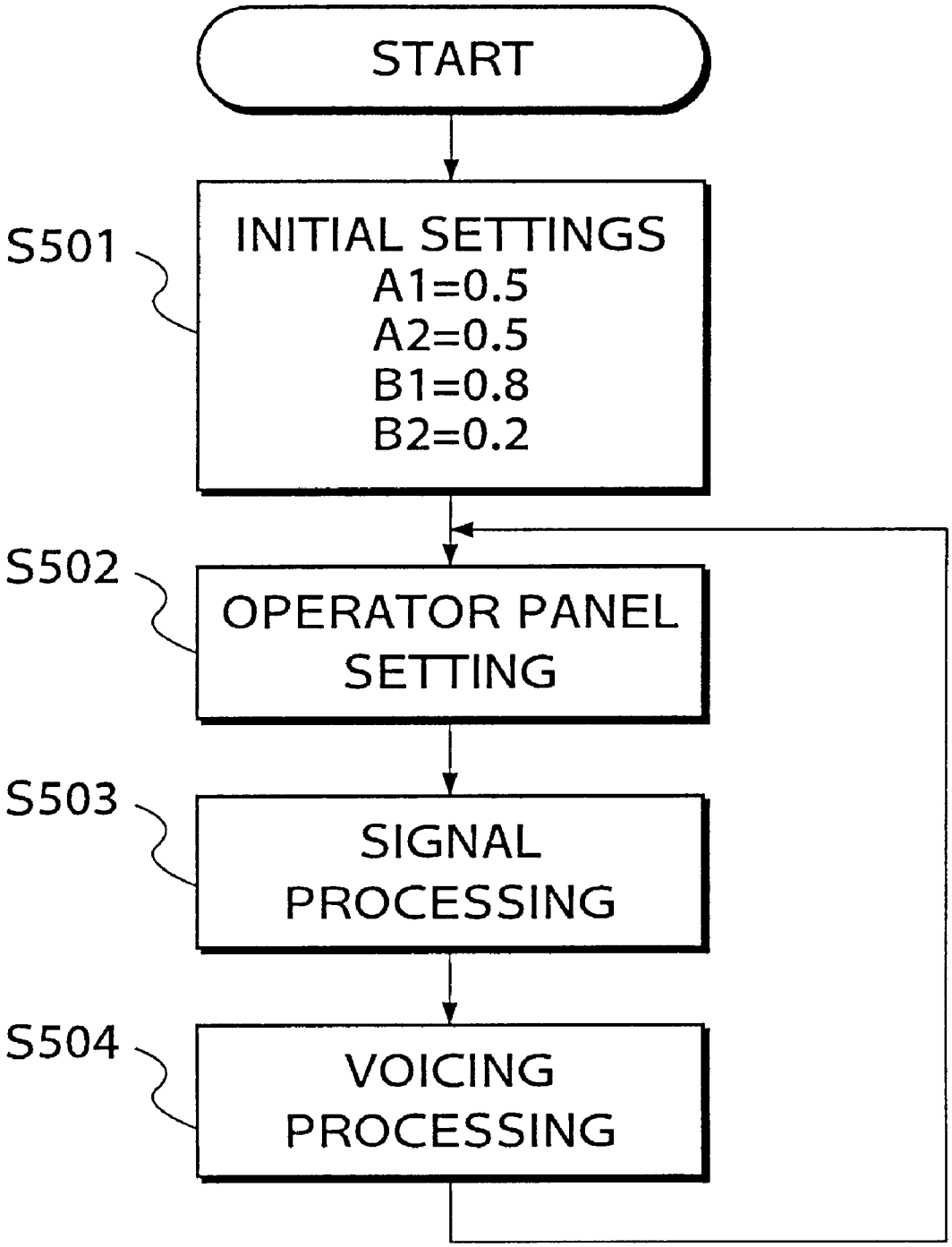
FIG. 5 is a flowchart indicative of a main operation of the above-mentioned embodiment.

The following describes the basic operation of the embodied electronic musical instrument. FIG. 5 is a flowchart indicative of the basic operation of this electronic musical instrument. First, when the electronic musical instrument is powered on, the CPU 105 executes an initializing sequence such as loading the program from the ROM 106 and allocation of the work area in the RAM 107 (step S501). The coefficients to be used in the DSP 111, or the coefficients to be outputted from the coefficient controller 302, are set as follows:

A1=0.5

A2=0.5

B1=0.8

B2=0.2

These settings present a default state of the sound field effect when the distance perspective is narrowest (refer to FIGS. 4A and 4B). In this initializing sequence, the coefficients are set as mentioned above regardless of the setting state on the operator panel 102. The present embodiment is arranged so that, only when a status change event occurs, the setting change is made. This prevents a problem of imparting a sound field effect with no coefficient set if the operator panel 102 is not operated after power-on sequence.

When the initializing sequence has been completed, the CPU 105 executes operator panel processing (step S502). This operator panel processing is executed for changing the setting of the operator panel 102, and for treating an event such as pressing or releasing of a key of the keyboard 104. Especially, in the internal sound mode, the operator panel processing includes processing for generating a music sound signal. In the external sound mode, the operator panel processing includes the processing for separating a music sound signal supplied from the audio system 200 into a signal indicative of the harmonic component and another signal indicative of the non-harmonic component. When the operator panel processing has been completed, the CPU 105 executes signal processing for applying a sound field effect to the harmonic signal component and the non-harmonic signal component (step S503). This signal processing causes the DSP 111 to form the sound field effect applying algorithm shown in FIG. 3. Then, the CPU 105 supplies the music sound signal treated by the signal processing to the DAC 112 to execute processing for sounding the resultant analog music sound signal through the amplifier 113 and the loudspeakers 101 (step S504). Subsequently, this electronic musical instrument cyclically repeats the processing of steps S502, S503, and S504 until the power is turned off. Thus, the processing is executed in response to an event generated.

2-1: Operator panel processing

Figure 6:
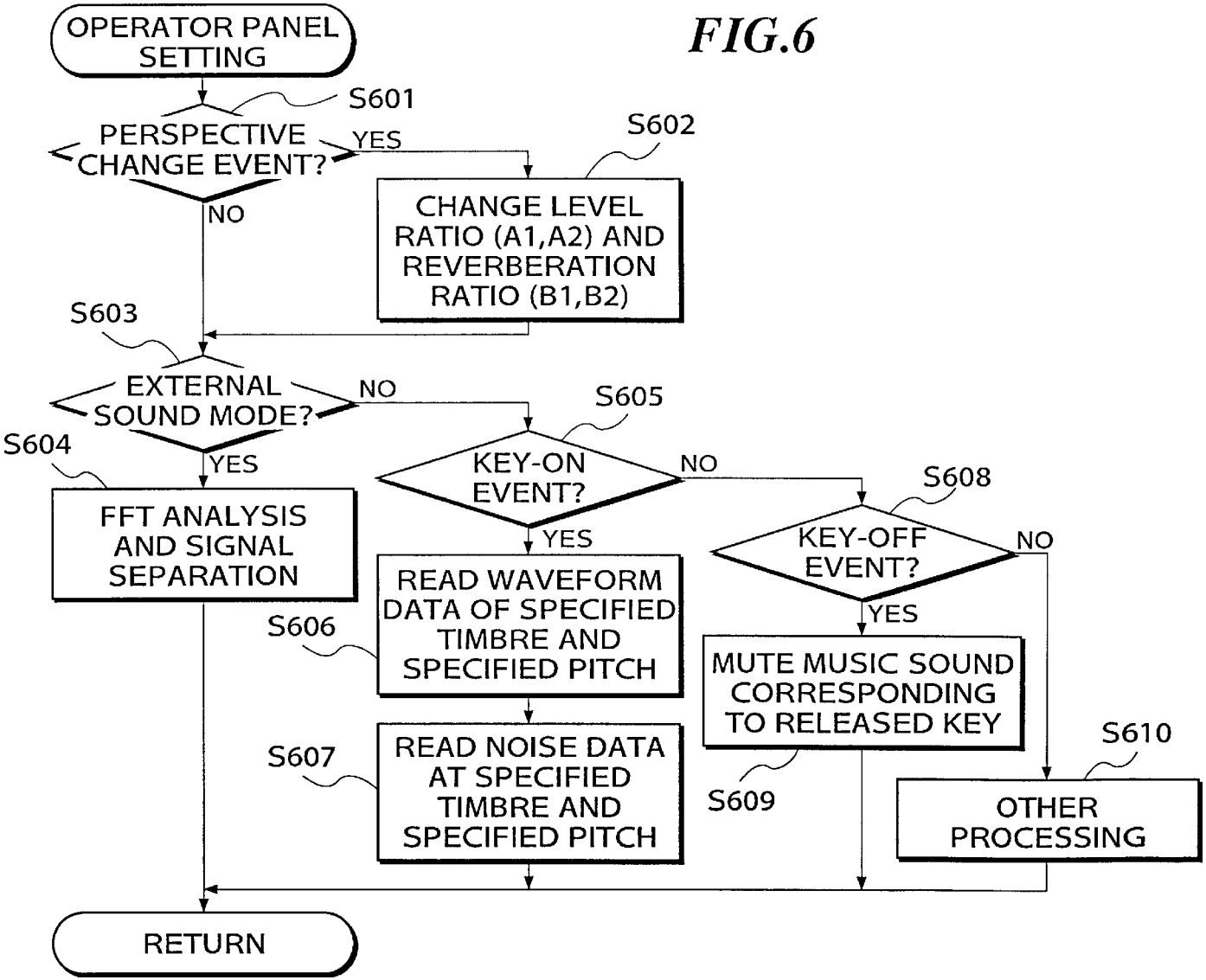
FIG. 6 is a flowchart indicative of details of panel setting processing of the above-mentioned main operation.

The following describes details of the above-mentioned operator panel processing of step S502 with reference to FIG. 6. As described, this operator panel processing executes processing for a detected event. The event is detected as follows. For example, an event associated with a change of settings by the operator panel 102 is detected by storing these settings every time the operator panel processing is executed, and by comparing the same with the previously stored settings. An event associated with the pressing or releasing of a key on the keyboard 104 can be detected by key-on data or key-off data. If a music sound is generated based on MIDI-based performance data, a resultant event can be detected by a note-on message or a note-off message.

In the operator panel processing, the CPU 105 first checks for a perspective change event (step S601). The perspective change event indicates that the settings of the reverberation effect, namely the parameter indicative of the distance perspective of the sound field effect, has been changed. If the perspective change event is found, the CPU 105 sets the coefficients B1 and B2 for specifying a degree of the reverberation effect to the coefficient controller 302 according to the changed parameter. At the same time, the CPU 105 changes the settings of coefficients A1 and A2 for specifying the level ratio between the harmonic component and the non-harmonic component (step S602). When the setting change for these coefficients has been completed or no perspective change event is found, the CPU 105 determines whether the current mode of the electronic musical instrument is the external sound mode (step S603). If the current mode is the external sound mode, the CPU 105 executes FFT on the external musical sound signal supplied from the audio system 200 as described above to divide the music sound signal into a signal indicative of the harmonic component and another signal indicative of the non-harmonic component (step S604).

On the other hand, if the current mode is not the external sound mode but the internal sound mode, the CPU 105 determines whether a key-on event has occurred (step S605). The key-on event denotes a key pressing operation by the user at a key of the keyboard 104. If a music sound is automatically generated based on performance data, the key-on event denotes the output of note-on data. Thus, the key-on event refers to a time at which a music sound is to be generated.

If the key-on event is found, the CPU 105 transfers data indicative of the timbre of a music sound to be generated and note-on data accompanying the detected key-on event to the sound generator 109. For the MIDI-based data, the CPU 105 transfers a note-on message accompanying note-on data. The sound generator 109 reads waveform data corresponding to the specified timbre at the pitch according to the note data, thereby generating a harmonic-component signal of the music sound having the specified timbre and the specified pitch (step S606).

Then, the sound generator 109 filters a white noise, for example, according to the timbre and pitch of the music sound to be generated, thereby generating a non-harmonic component signal (step S607). This non-harmonic component signal may be generated to electrically simulate a breath-in sound of a performer if the specified timbre is of a flute. If the specified timbre is of a violin, the non-harmonic component signal may be generated to simulate a bow rubbing sound. Thus, in steps S606 and S607, the harmonic component and the non-harmonic component of the music sound signal have been generated in response to the key-on event.

On the other hand, if no key-on event is found, the CPU 105 checks for a key-off event (step S608). A key-off event occurs when the user executes a key releasing operation on the keyboard 104. If a music sound is automatically generated based on the performance data, a key-off event is recognized when a note-off message is outputted. Thus, the key-off event refers to a time at which the music sound generated by the key-on event is to be turned off. If a key-off event is found, the CPU 105 supplies the key-off data to the sound generator 109. For the MIDI based data, the CPU 105 transfers a note-off message accompanying note data. Then, the sound generator 109 stops generating of the music sound having the pitch indicated by the note data at the current time (step S609). Thus, the music sound generated by the key-on event is turned off by the key-off event.

If no key-off event is found, the CPU 105 executes processing corresponding to the change in an operated switch in the operator panel 102 (step S610). For example, if volume has been adjusted or a timbre has been changed, the CPU 105 rewrites the setting accordingly. When the harmonic component signal and the non-harmonic component signal have been obtained (steps S604, S606, and S607), or when the note-off processing has been completed (step S609), or when the other processing has been completed (step S610), the CPU 105 returns the processing to the main routine shown in FIG. 5 to thereby cyclically repeat the above-mentioned operations.

2-2: Signal processing

The following describes the signal processing in step S503 of the main routine and, more particularly, describes how the algorithm shown in FIG. 3 is executed by this signal processing. It should be noted that this signal processing may be executed by the CPU 105 itself if the same has a high computational capability. In the present embodiment, the DSP 111 executes this signal processing under the control of the CPU 105 to mitigate the load thereof. Consequently, in the present embodiment, the CPU 105 functions as the coefficient controller 302 to supply the coefficients A1, A2, B1 and B2 according to the distance perspective parameter, and controls the DSP 111 so that the following control procedure is provided.

Figure 7:
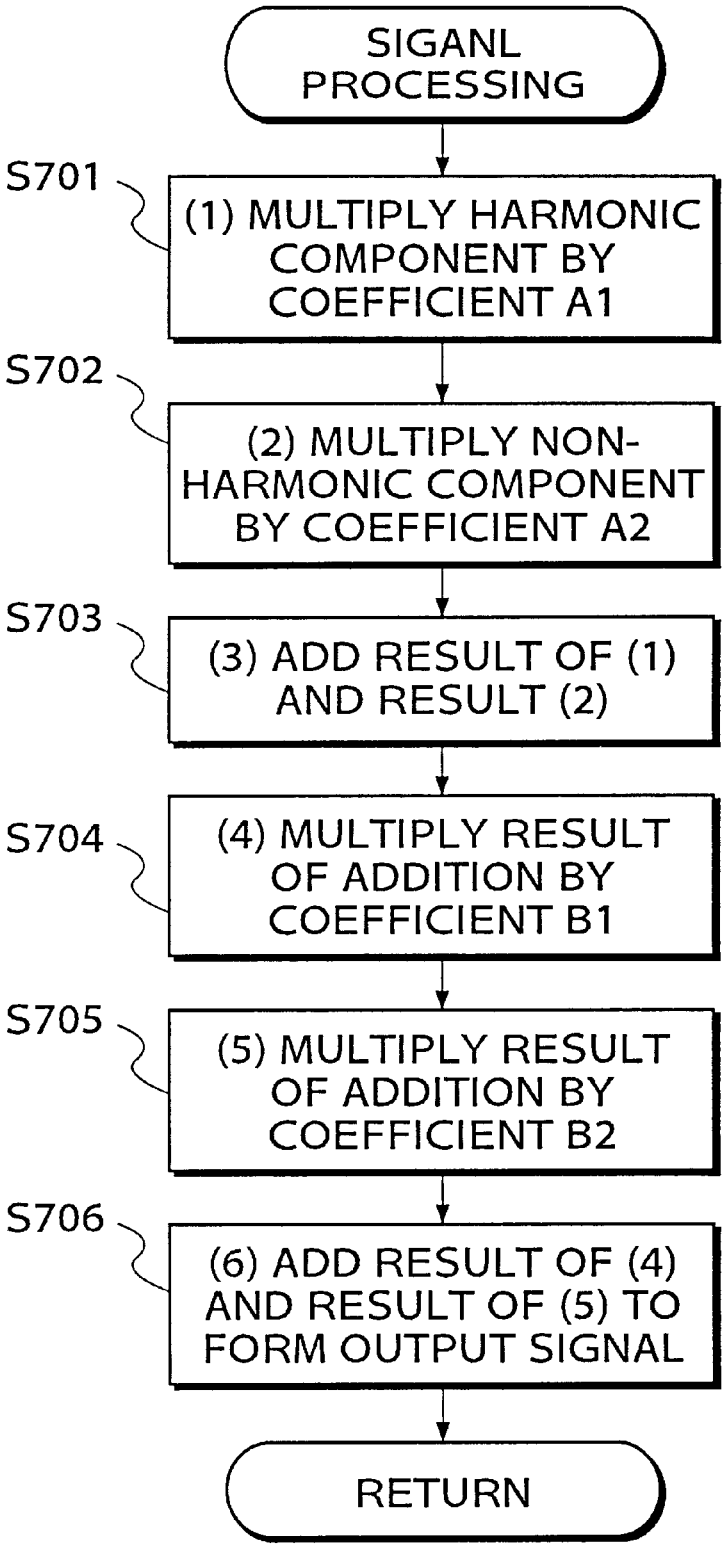
FIG. 7 is a flowchart indicative of details of signal processing of the above-mentioned main operation.

FIG. 7 shows a flowchart indicative of the signal processing procedure. First, the DSP 111 multiplies the harmonic component by the coefficient A1 and stores the result (1) into an internal register (step S701). This step corresponds to the computation by the multiplier M1 shown in FIG. 3. Second, the DSP 111 multiplies the non-harmonic component by the coefficient A2 and stores the result (2) into the internal register (step S702). This step corresponds to the computation by the multiplier M2 shown in FIG. 3. Third, the DSP 111 reads the multiplication results (1) and (2) from the internal register, adds the results together, and stores the result (3) of this addition into the internal register (step S703). This step corresponds to the computation by the adder S1 shown in FIG. 3. Fourth, the DSP 111 reads the result (3) of the addition executed in step S703 from the internal register, multiplies the read result by the coefficient B1, and stores the result (4) of this multiplication into the internal register (step S704). This step corresponds to the computation by the multiplier M3 shown in FIG. 3. Fifth, the DSP 111 reads the result (3) of the addition executed in the previous signal processing in step S703 from the internal register, multiplies the read result by the coefficient B2, and stores the result (5) into the internal register (step S705). It should be noted that the previous signal processing denotes the signal processing executed before a time equivalent to a reflected sound delay time before the current signal processing. Therefore, the signal before the multiplication, which is read here, is delayed by a time equivalent to a travel time of the reflected sound. This step corresponds to the computation by the multiplier M4 shown in FIG. 3. Sixth, the DSP 111 reads the results (4) and (5) obtained by steps S704 and S705 from the internal register, adds these results together, and supplies the result (6) of this addition to the DAC 112 (step S706). This step corresponds to the computation by the adder S2 shown in FIG. 3.

Figure 8:
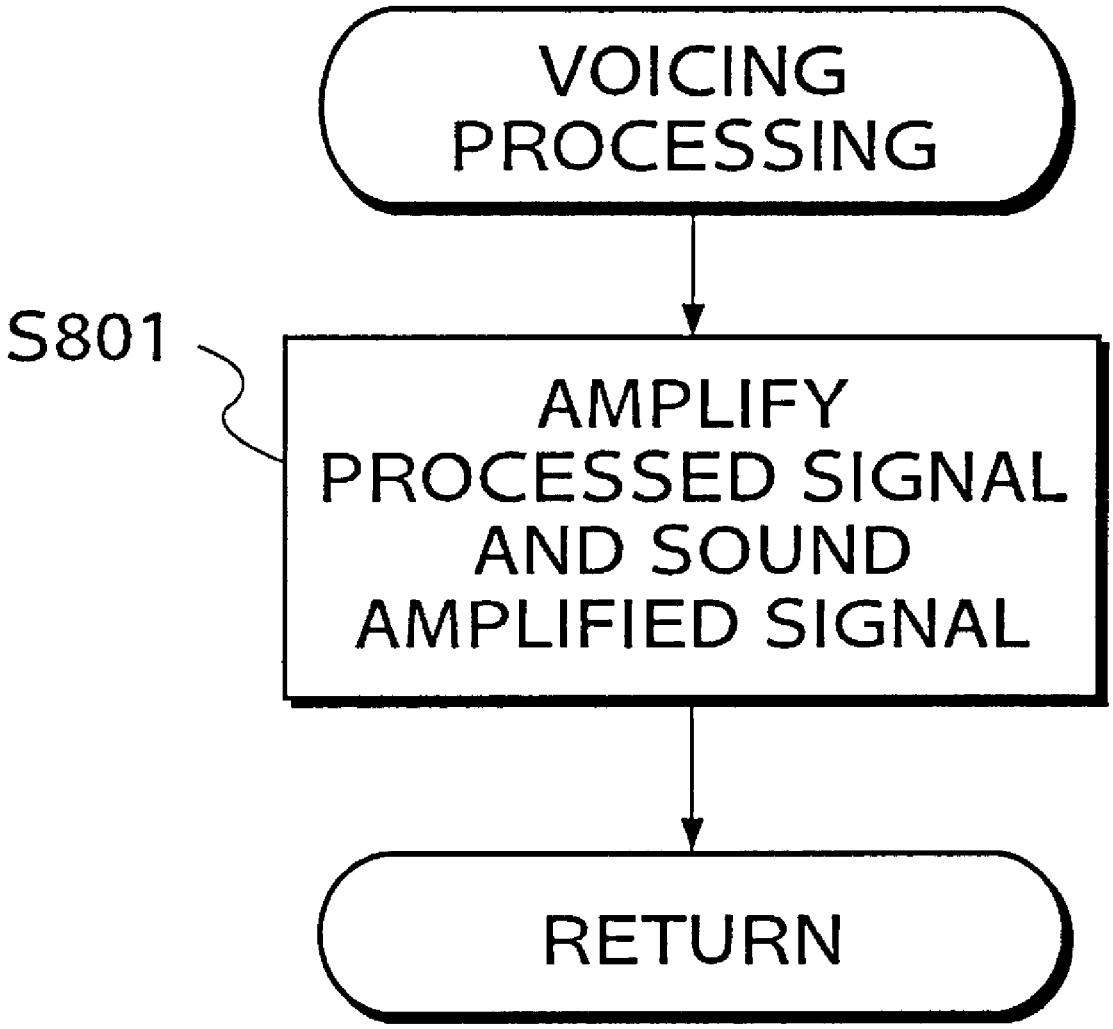
FIG. 8 is a flowchart indicative of details of voice processing of the above-mentioned main operation.

Subsequently, in the sounding process shown in FIG. 8, the signal processed as described above is amplified and sounded (step S801). Thus, as the algorithm shown in FIG. 3 has been realized by the DSP 111, the reverberation effect is imparted to the music sound signal having the harmonic component and the non-harmonic component by considering the acoustic nature of the noise or the non-harmonic component in the reverberation. Consequently, the music sound outputted from the loudspeakers 101 is accompanied by the sound field effect having the realistic distance perspective.

3: Specific operations of the embodiment

The following describes specific operations of the embodied electronic musical instrument. As described, when the electronic musical instrument is powered on, the processing of the main routine is executed. After initialization, the operations of steps S501 through S503 are cyclically repeated. In this repetition, pressing any of the keys of the keyboard 104 causes a key-on event. The operator panel processing upon pressing of the key generates the harmonic component and the non-harmonic component of the music sound signal corresponding to the pressed key. The subsequent signal processing applies the reverberation effect to this music sound signal, which is then outputted by the sounding process. In the cyclic repetition of steps S502 through S504, releasing the pressed key of the keyboard 104 causes a key-off event. The operator panel processing upon the key releasing operation stops the generation of the music sound signal corresponding to the released key. This mutes the music sound corresponding to the released key. On the other hand, in the cyclic repetition of steps S502 through S504, operating one of the control switches of the operator panel 102 causes a control event. The operator panel processing upon this operation causes a change in the settings of the operated control swich. Subsequently, the cyclic processing is continued according to the changed settings. Therefore, changing the parameter indicative of the distance perspective through the operator panel 102 causes adjustment of the coefficients A1 A2, B1, and B2 in step S602 of the operator panel processing immediately after the changing of the parameter. Subsequently, the reverberation effect specified by the changed coefficients is created.

4: Application and variation

It is obvious to those skilled in the art that the present invention is not limited to the above-mentioned specific embodiment. For example, various applications and variations that follow may be made.

4-1: Effect creation by hardware

In the above-mentioned embodiment, the sound field effect is created by an algorithm formed by the DSP 111 or the CPU 105 in software approach. Alternatively, the sound field effect may be created in hardware approach by use of multipliers and adders.

4-2: Fragmentation of sound components

In the above-mentioned embodiment, the music sound signal is divided into a harmonic signal component and a non-harmonic signal component. The music sound signal may also be separated into more number of signal components depending on noise types for example. In this case, the coefficient controller 302 generates the number of coefficients corresponding to the number of resultant components in correlation with the parameters of distance perspective.

4-3: Inputting harmonic and non-harmonic components

In the external sound mode, the externally inputted music sound signal is separated into the harmonic component and the non-harmonic component. Alternatively, a harmonic component signal and a non-harmonic component signal may be recorded separately in advance before being inputted into the electronic musical instrument.

4-4: Combining two modes

In the above-mentioned embodiment, the internal sound mode and the external sound mode are provided separately. Alternatively, both of the modes may be combined into one.

The combined mode allows a harmonic component to be formed by the electronic musical instrument and a recorded noise to be used as a non-harmonic component.

4-5: Effect types

In the above-mentioned embodiment, the effect to be created is the reverberation, and the mixing ratio between the direct sound and the reflected sound is controlled. The present invention is also applicable to any other effects for imparting distance perspective to a music sound signal by controlling the mixing ratio of a non-harmonic component such as noise to a harmonic component.

4-6: Machine readable medium

Referring to FIG. 2, the invention covers a machine readable medium 119 such as a CD-ROM inserted into a disc drive 118 of the electronic musical instrument. The machine readable medium 119 is used in the electronic musical instrument composed of a computer machine having the CPU 105 for producing a music sound while applying thereto a desired sound field effect according to a control parameter. The medium 119 contains program instructions for causing the computer machine to perform the method comprising the steps of providing an input music sound composed of at least two sound components separable from each other, multiplying levels of the two sound components by different multiplication factors for undergoing a level change of the two sound components separately from each other, mixing the two sound components after the level change to produce an output music sound, applying the sound field effect to the output music sound according to the control parameter which characterizes the sound field effect, and adjusting the respective multiplication factors according to the control parameter so that the levels of the two sound components can be regulated provisionally in matching with the sound field effect.

As described and according to the invention, a sound field effect according to a distance of perspective is created by considering the acoustic nature of a non-harmonic component such as noise, thereby presenting performance atmospherics significantly close to live performance.

While the preferred embodiment of the present invention has been described using specific terms, such description is for illustrative purposes only, and it is to be understood that changes and variations may be made without departing from the spirit or scope of the appended claims.

What is claimed is:

1. An apparatus for applying a desired sound field effect to a music sound signal composed of at least two signal components, the apparatus comprising:

level regulating means for conducting a level regulation to regulate levels of the two signal components independently from each other;

sound field applying means for applying the sound field effect to the music sound signal containing the two signal components subjected to the level regulation by the level regulating means; and level controlling means for automatically controlling the level regulation of the level regulating means according to the sound field effect applied by the sound field applying means.

2. An apparatus for applying a desired sound field effect to a music sound signal composed of at least two signal components, the apparatus comprising:

level regulating means for conducting a level regulation to regulate levels of the two signal components independently from each other;

sound field applying means for applying the sound field effect to the music sound signal containing the two signal components subjected to the level regulation by the level regulating means;

level controlling means for controlling the level regulation of the level regulating means according to the sound field effect applied by the sound field applying means; and means for providing the level regulating means with a music sound signal composed of a harmonic signal component containing a fundamental wave and overtone waves of the music sound signal and a non-harmonic signal component containing other than the fundamental wave and the overtone waves.

3. The apparatus according to claim 2, wherein the sound field applying means applies the sound field effect to create a sense of distance in the music sound signal, and wherein the level controlling means controls the level regulation according to the sense of distance created by the sound field effect such that the level of the non-harmonic signal component is made small relative to the level of the harmonic signal component as the sense of distance becomes far.

4. A music apparatus for producing a music sound while applying thereto a desired sound field effect according to a control parameter, the apparatus comprising:

a source device that provides an input music sound composed of at least two sound components separable from each other;

a multiplier device that multiplies levels of the two sound components by different multiplication factors for undergoing a level change of the two sound components separately from each other;

an adder device that adds the two sound components after the level change to produce an output music sound;

an effector device that applies the sound field effect to the output music sound according to the control parameter which characterizes the sound field effect; and a controller device that adjusts the respective multiplication factors according to the control parameter so that the levels of the two sound components can be regulated provisionally in matching with the sound field effect.

5. The music apparatus according to claim 4, wherein the source device provides an input music sound composed of a harmonic sound component containing a fundamental wave and overtone waves of the music sound and a non-harmonic sound component containing a noise other than the fundamental wave and the overtone waves, so that the respective levels of the harmonic sound component and the non-harmonic sound component can be regulated to enhance the sound field effect created by the effector device.

6. The music apparatus according to claim 5, wherein the effector device applies the sound field effect to create a sense of distance in the music sound, and wherein the controller device controls the respective levels of the harmonic sound component and the non-harmonic sound component to enhance the sense of distance created by the effector device such that the level of the non-harmonic sound component is made small relative to the level of the harmonic sound component as the sense of distance becomes remote.

7. The music apparatus according to claim 5, wherein the source device comprises a sound generator that generates an input music sound composed of the harmonic sound component and the non-harmonic sound component, which are generated separately from each other.

8. The music apparatus according to claim 5, wherein the source device comprises a sound player that reproduces an input music sound composed of the harmonic sound component and the non-harmonic sound component, and an analyzer that analyzes the reproduced input music sound to separate the harmonic sound component and the non-harmonic sound component from each other.

9. A method of producing a music sound while applying thereto a desired sound field effect according to a control parameter, the method comprising the steps of:

providing an input music sound composed of at least two sound components separable from each other;

multiplying levels of the two sound components by different multiplication factors for undergoing a level change of the two sound components separately from each other;

mixing the two sound components after the level change to produce an output music sound;

applying the sound field effect to the output music sound according to the control parameter which characterizes the sound field effect; and adjusting the respective multiplication factors according to the control parameter so that the levels of the two sound components can be regulated provisionally in matching with the sound field effect.

10. A machine readable medium for use in a music machine having a CPU and producing a music sound while applying thereto a desired sound field effect according to a control parameter, the medium containing program instructions for causing the music machine to perform the method comprising the steps of:

providing an input music sound composed of at least two sound components separable from each other;

multiplying levels of the two sound components by different multiplication factors for undergoing a level change of the two sound components separately from each other;

mixing the two sound components after the level change to produce an output music sound;

applying the sound field effect to the output music sound according to the control parameter which characterizes the sound field effect; and adjusting the respective multiplication factors according to the control parameter so that the levels of the two sound components can be regulated provisionally in matching with the sound field effect.

* * * * *